US007543812B2

(12) United States Patent
Underwood et al.

(10) Patent No.: US 7,543,812 B2
(45) Date of Patent: Jun. 9, 2009

(54) MEDIA REGISTRATION DEVICES

(75) Inventors: John A Underwood, Vancouver, WA (US); Denis B O'Regan, Camas, WA (US); Hans-Robert Ketterer, Baden-Württemberg (DE); Andreas Kloos, Baden-Württemberg (DE); Rainer Wertz, Baden-Württemberg (DE)

(73) Assignee: Hewlett-Packard Development Company, L.P., Houston, TX (US)

( * ) Notice: Subject to any disclaimer, the term of this patent is extended or adjusted under 35 U.S.C. 154(b) by 165 days.

(21) Appl. No.: 11/590,718

(22) Filed: Oct. 31, 2006

(65) Prior Publication Data

US 2008/0099986 A1 May 1, 2008

(51) Int. Cl.
*B65H 1/00* (2006.01)
*B65H 1/26* (2006.01)

(52) U.S. Cl. ..... 271/145; 271/171; 271/162; 271/157; 399/393; 347/104

(58) Field of Classification Search ..... 271/145, 271/171, 162; 399/393; 347/104
See application file for complete search history.

(56) References Cited

U.S. PATENT DOCUMENTS

| | | | | |
|---|---|---|---|---|
| 5,573,236 | A | 11/1996 | Petocchi et al. | |
| 6,536,760 | B1 | 3/2003 | Spina et al. | |
| 6,619,656 | B2 | 9/2003 | Guddanti et al. | |
| 6,644,502 | B2 * | 11/2003 | Pearce et al. | 221/127 |
| 6,688,592 | B1 | 2/2004 | Tan et al. | |
| 6,935,629 | B2 | 8/2005 | Asada | |
| 7,258,338 | B2 * | 8/2007 | Lee et al. | 271/171 |
| 2004/0021265 | A1 | 2/2004 | Tan et al. | |
| 2004/0188923 | A1 | 9/2004 | Asada | |
| 2005/0133983 | A1 | 6/2005 | Jacobs et al. | |
| 2005/0269764 | A1 | 12/2005 | Lee et al. | |

FOREIGN PATENT DOCUMENTS

JP 04243732 A * 8/1992

* cited by examiner

*Primary Examiner*—Patrick H Mackey
*Assistant Examiner*—Luis Gonzalez

(57) ABSTRACT

An apparatus for automatically registering a stack of media includes a lever device adapted to be secured to a media tray of a printer, and to pivot in relation to the media tray when the media tray is inserted into the printer, and a registration wall mechanically coupled to the lever device such that the registration wall is repositioned toward the stack of media when the media tray is inserted into the printer.

20 Claims, 12 Drawing Sheets

FIG. 5A
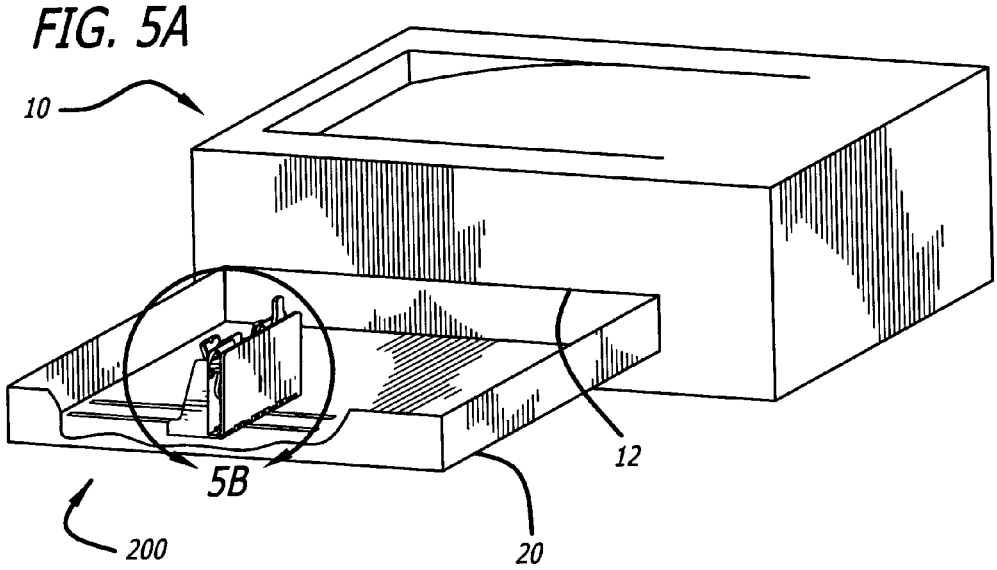
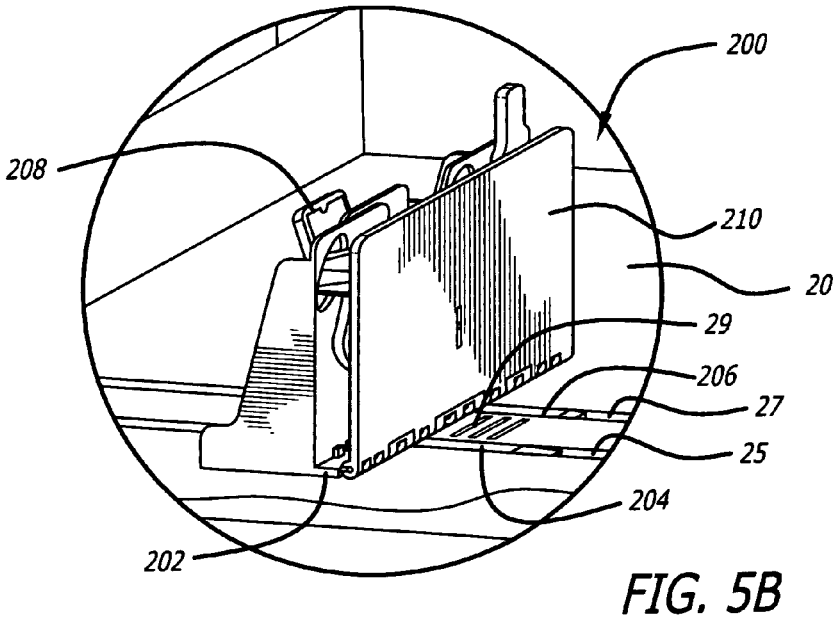
FIG. 5B

MEDIA REGISTRATION DEVICES

BACKGROUND

Printers often include one or more media trays into which media are loaded. Typically the media trays include one or more manually adjustable media guides for setting the size of the media receiving area in the tray to accommodate a particular size of media, e.g., standard letter size (8.5×11 inches) or A4 letter size. Unfortunately, some users have difficulty with loading a stack of media into a media receiving area where the media guides (or other boundaries, walls, etc.) are closely adjacent to the perimeter boundary of the media receiving area. Also, sometimes a user finds it difficult to remove articles of media from a media tray, for example, to replace standard letter size paper media with standard letter size transparencies.

Furthermore, the set point of a media guide may be too tight or too loose. If too loose, the media can move and cause a decrease in pick performance in the form of skew or media jams. If too tight, as mentioned above, it can be difficult to load the media stack, which can lead to poorly loaded media which in turn can lead to a decrease in pick performance in the form of media jams. Also, an overly tight media guide can result in the operator/user loosening the media guide from its correct position leading to the too loose problems mentioned above.

It would be helpful to be able to provide a media registration device that makes it easier for a user of a printer to load a stack of media into a media tray. It would be helpful to be able to provide a media registration device that makes it easier for a user of a printer to remove a stack of media from a media tray. It would be helpful to be able to provide a media registration device that addresses the problems of conventional media guides being set too tight or too loose in relation to a media receiving area. It would be helpful to provide a media registration device that does not include electrically powered components.

BRIEF DESCRIPTION OF THE DRAWINGS

Detailed description of embodiments of the invention will be made with reference to the accompanying drawings:

FIG. 5A is a perspective view of a printer with a media tray configured with another example embodiment of a media registration device;

FIG. 5B is a perspective view of the media registration device of FIG. 5A shown secured to the media tray;

DETAILED DESCRIPTION

The following is a detailed description for carrying out embodiments of the invention. This description is not to be taken in a limiting sense, but is made merely for the purpose of illustrating the general principles of the example embodiments of the invention.

Figure 1A:
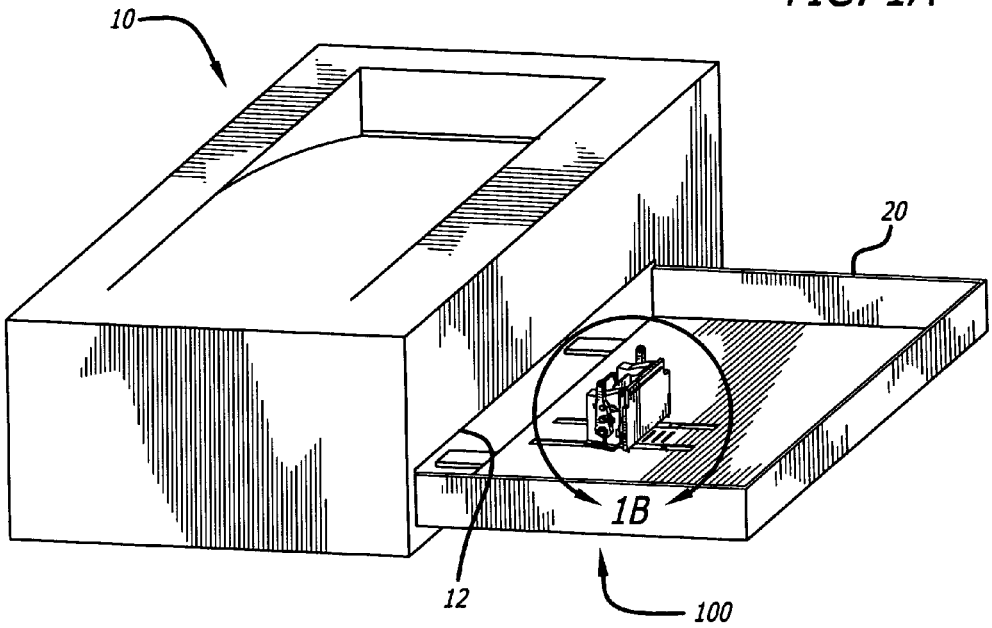
FIG. 1A is a perspective view of a printer with a media tray configured with an example embodiment of a media registration device.
Figure 1B:
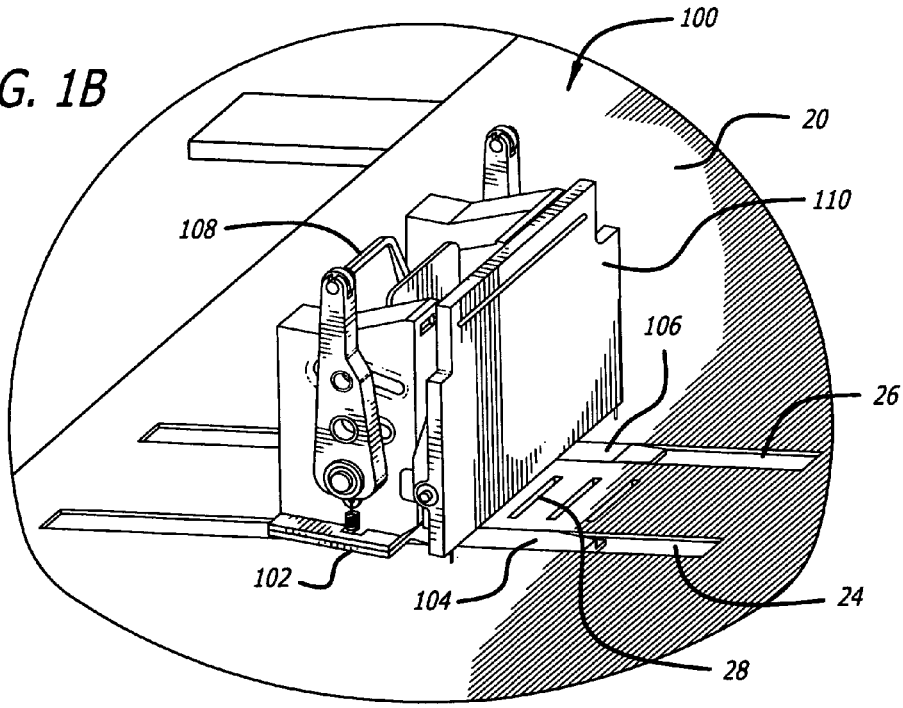
FIG. 1B is a perspective view of the media registration device of FIG. 1A shown secured to the media tray.

FIGS. 1A and 1B show a printer 10 with a media tray 20. In an example embodiment, the printer 10 is adapted (in a conventional fashion) to withdraw an article of media from the media tray 20 and to impart visible indicia upon the article of media. By way of example, but not of limitation, the printer 10 can be a laser printer, or inkjet printer.

Embodiments described herein generally involve providing a media tray with one or more media registration devices. In this example embodiment, a media registration device 100 includes a base 102 above rails 104 and 106, which are sized to fit within and slide along tracks 24 and 26, respectively, of the media tray 20. The media registration device 100 is mechanically coupled to the media tray 20. In this example embodiment, a tab member 108 of the media registration device 100 is inserted into a slot 28 to secure the media registration device 100 to the media tray 20. "Coarse" positional adjustments of the media registration device 100 along the tracks 24 and 26 are made by withdrawing the tab member 108 from one slot 28, and sliding the media registration device 100 to a desired position where the tab member 108 can be inserted into a different slot 28. In an example embodiment, the tab member 108 is sprung to bias the tab member 108 downward into a slot 28.

The media registration device 100 includes a registration wall 110 which is automatically extended and retracted when the media tray 20 is inserted into and withdrawn from the printer 10, respectively. After the media registration device 100 has been appropriately positioned for a particular media size, i.e., the "coarse" adjustment, the media registration device automatically provides "fine" positional adjustments of its registration wall 110 as discussed below.

Figure 2A:
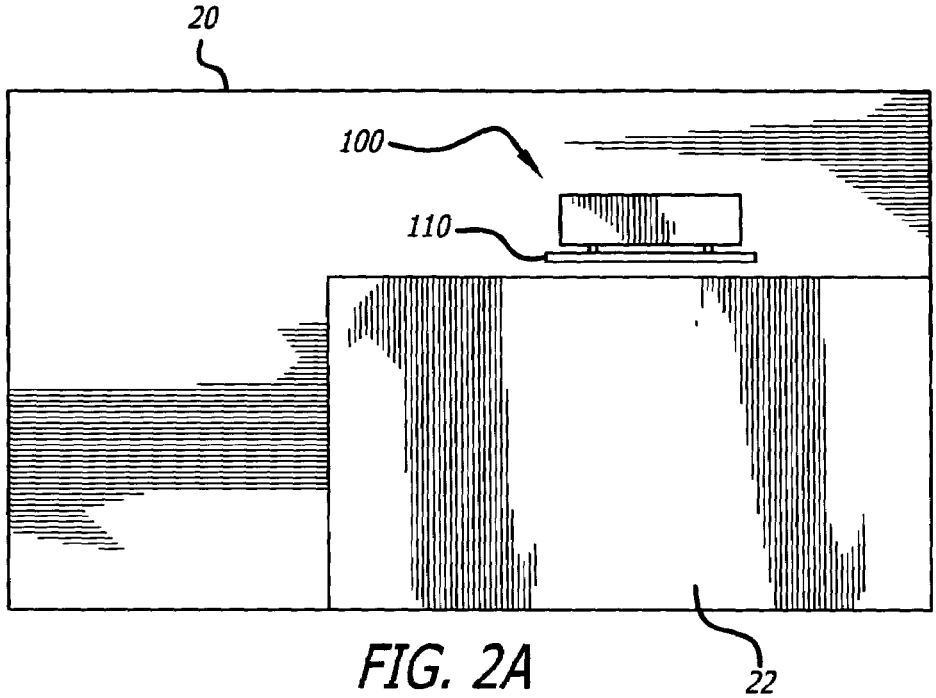
FIG. 2A is a top view of a media tray with the media registration wall of the media registration device of FIG. 1A shown in its retracted position.
Figure 2B:
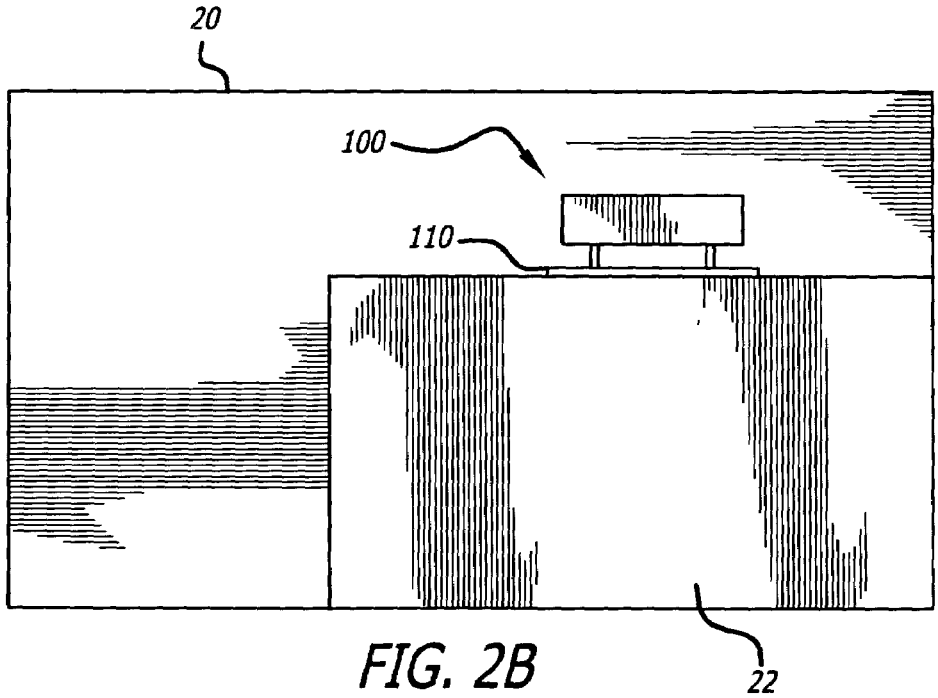
FIG. 2B is a top view of a media tray with the media registration wall of the media registration device of FIG. 1A shown in its laterally extended position.

FIG. 2A shows the registration wall 110 of the media registration device 100 in its retracted position. FIG. 2B shows the registration wall 110 of the media registration device 100 in its laterally extended position.

Figure 3A:
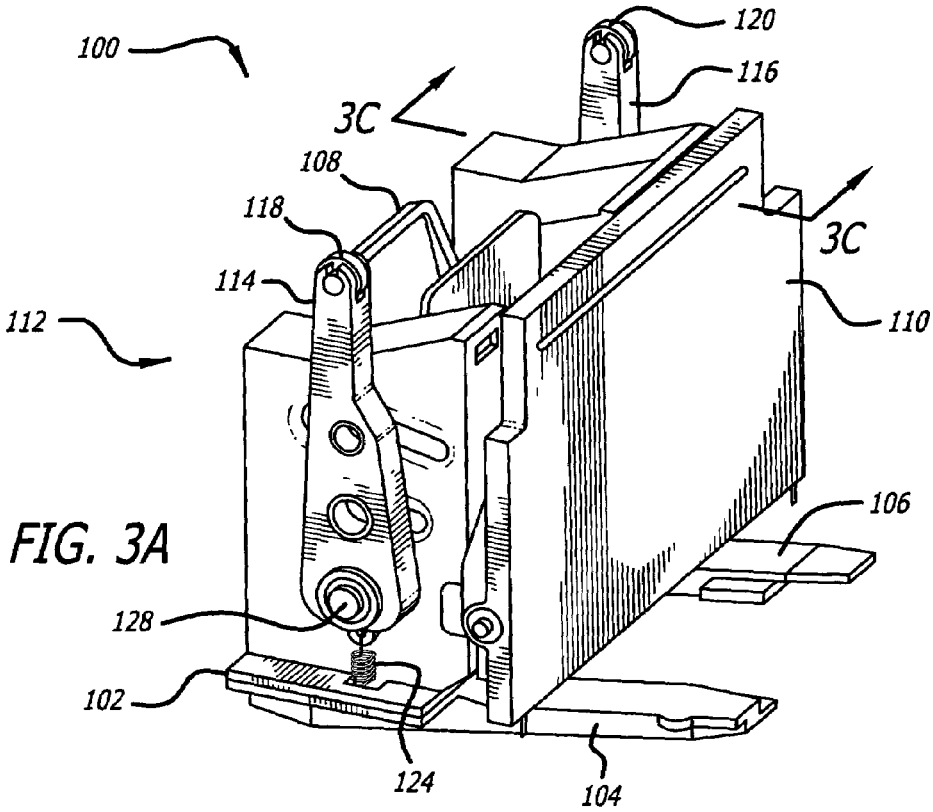
FIG. 3A is a perspective view of the media registration device of FIG. 1A with its media registration wall shown in its laterally extended position.
Figure 3B:
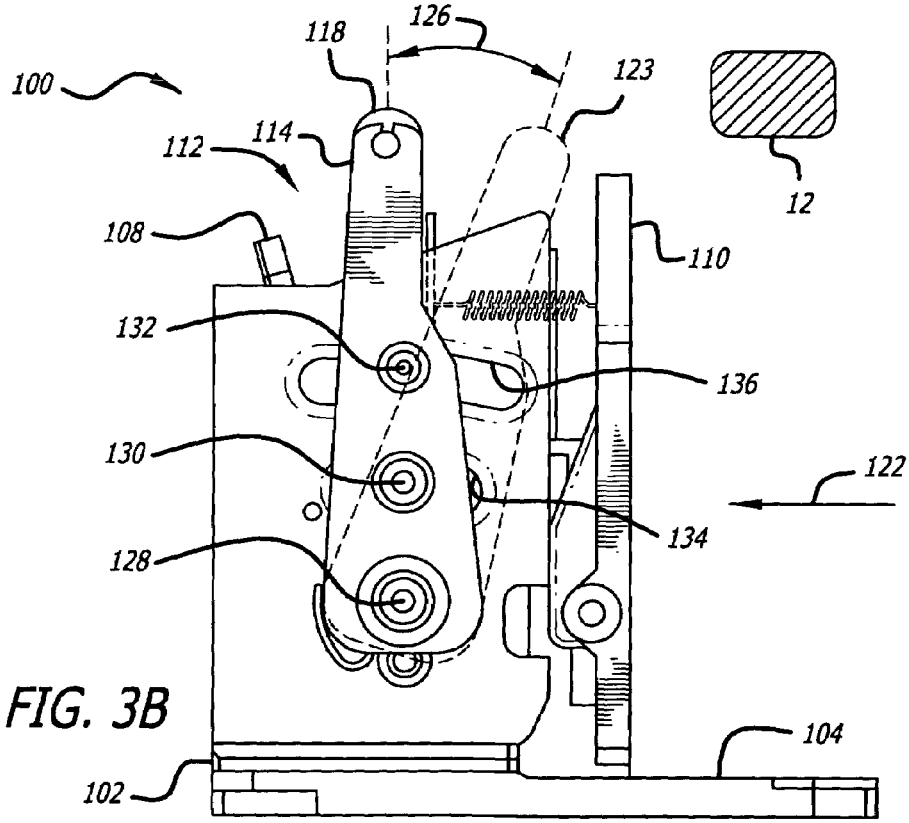
FIG. 3B is a side view of the media registration device of FIG. 3A.
Figure 3C:
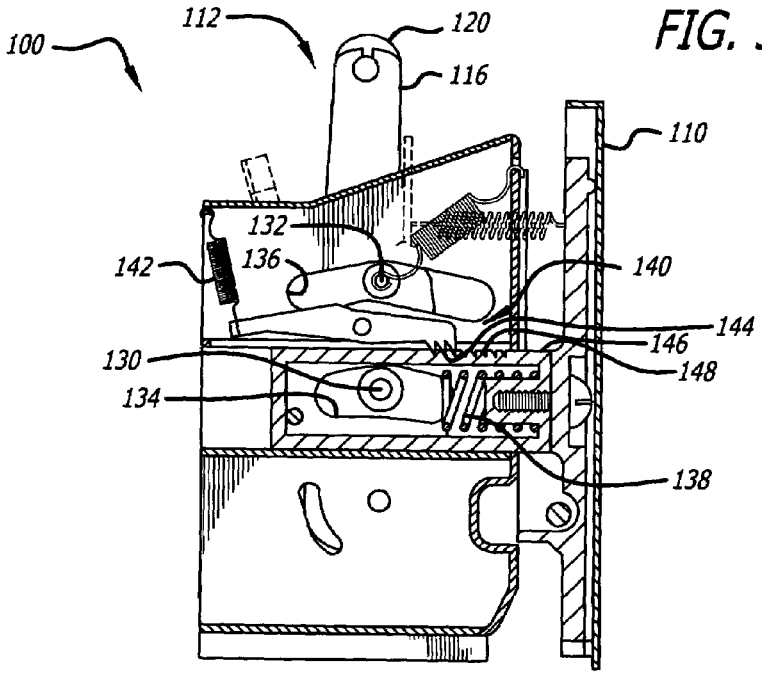
FIG. 3C is a cross-sectional side view of the media registration device along line 3C-3C of FIG. 3A.

Referring to FIGS. 3A-3C, in this example embodiment, the media registration device 100 includes a lever device 112 to which the registration wall 110 is mechanically coupled. In this example embodiment, the lever device 112 includes two members (arm members) 114 and 116 for contacting a portion of the printer 10. In this example embodiment, the arm members 114 and 116 are positioned on opposite ends of, and symmetrically positioned along, the lever device 112. In this example embodiment, end wheels 118 and 120 are mechanically coupled as shown to the top of each of the arm members 114 and 116, respectively.

FIG. 3B shows a stationary bar (edge) 12 of the printer 10. An arrow 122 points in the direction of movement of the media registration device 100 in relation to the edge 12, when the media tray is being inserted into the printer 10. A dashed line 123 shows the position of the arm member 114 when the media registration device 100 is being pushed past the edge 12. A spring 124 (FIG. 3A), which is attached a bottom portion of the arm member 114 to the base 102, returns the arm member 114 to its upright (substantially vertical) position after the media registration device 100 has been pushed past the edge 12 as shown in FIG. 3B. The movement of the arm members 114 and 116 toward the registration wall 110, as denoted by curved arrow 126, pushes the registration wall 110 to its extended (or engaged) position. The arm members 114 and 116 each pivot about a bearing 128 during movement. The lever device 112 includes members 130 and 132 which are attached to each of the arm members 114 and 116 as shown. The members 130 and 132 extend through curved slots 134 and 136, respectively. When the arm members 114 and 116 are pivoted toward the registration wall 110, the members 130 contact springs 138 (FIG. 3C) which push the registration wall 110 toward its extended position. In an example embodiment, the compression force of the contact springs 138 is selected to be sufficiently small to prevent undue compression or buckling of the stack of media. In this example embodiment, the media registration device 100 includes a ratchet device 140 adapted to secure the registration wall 110 in a media registration position (the extended position). A spring 142 biases teeth 144 of the ratchet device 140 toward complementary teeth 146 on member 148 which is secured to the registration wall 110. While the registration wall 110 is pushed toward its extended position, movement of teeth 144 across complementary teeth 146, in combination with the bias provided by the spring 142, results in a "one-way" ratchet mechanism which locks the registration wall 110 in its extended position as shown in FIG. 3C. Thus, the aforedescribed components provide a means for mechanically coupling the registration wall 110 to the media tray 20 (which is adapted to hold a media stack 22), and means, responsive to inserting the media tray 20 into the printer 10, for repositioning the registration wall 110 in relation to the media tray 20.

In an example embodiment, an apparatus for automatically registering a stack of media includes a wall, means for mechanically coupling the wall to a media tray adapted to hold a stack of media, and means, responsive to inserting the media tray into a printer, for repositioning the wall in relation to the media tray.

In an example embodiment, an apparatus for automatically registering a stack of media includes a lever device adapted to be secured to a media tray of a printer, and to pivot in relation to the media tray when the media tray is inserted into the printer, and a registration wall mechanically coupled to the lever device such that the registration wall is repositioned (e.g., laterally repositioned) toward the stack of media when the media tray is inserted into the printer In an example embodiment, an apparatus includes a printer including a media tray, the printer being adapted to withdraw an article of media from the media tray and to impart visible indicia upon the article of media, and a media registration device including a wall, the media registration device being mechanically coupled to the media tray and adapted to automatically repositioned the wall to a media registration position when the media tray is inserted into the printer.

In an example embodiment, a method for automatically registering a stack of media includes inserting a media tray into a printer such that a lever mechanism which is mechanically coupled to the media tray contacts a portion of the printer causing a registration wall which is mechanically couple to the lever mechanism to extend toward a media registration position to substantially obstruct movement of the stack of media toward the registration wall.

Figure 4A:
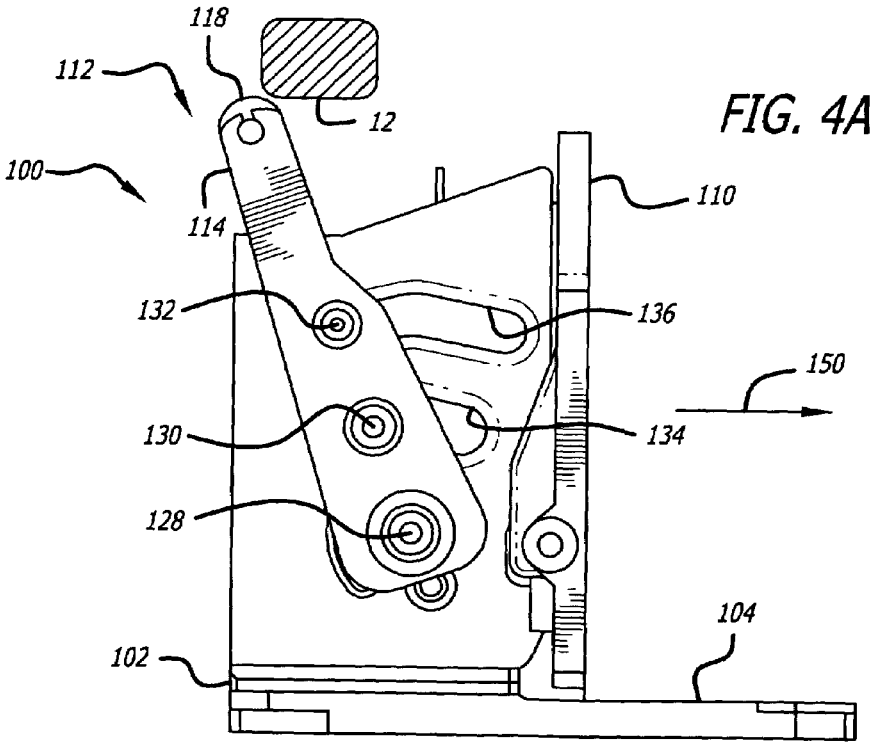
FIG. 4A is a side view of the media registration device of FIG. 1A with its media registration wall shown in its retracted position.
Figure 4B:
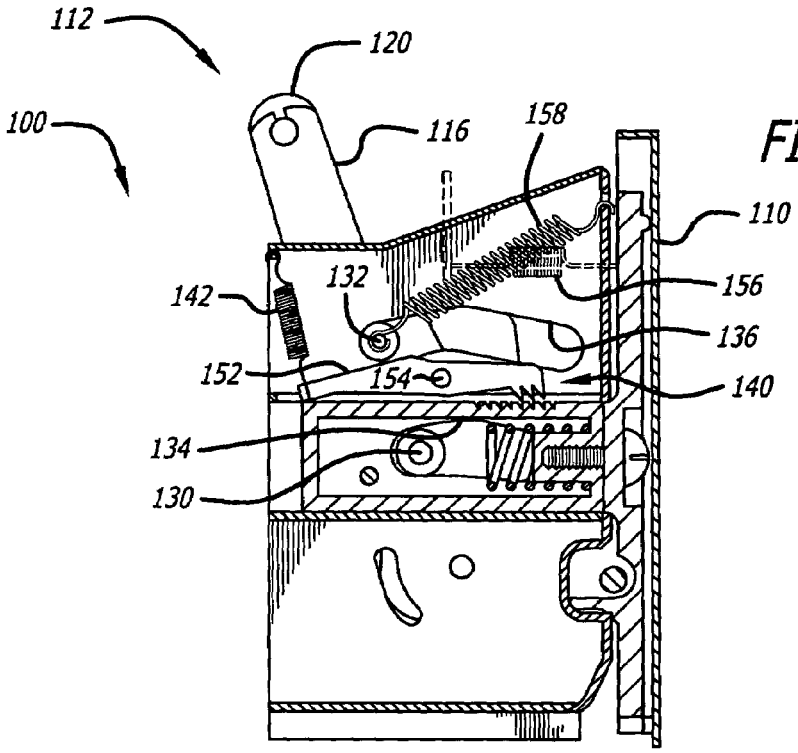
FIG. 4B is a cross-sectional side view of the media registration device of FIG. 4A.
Figure 4C:
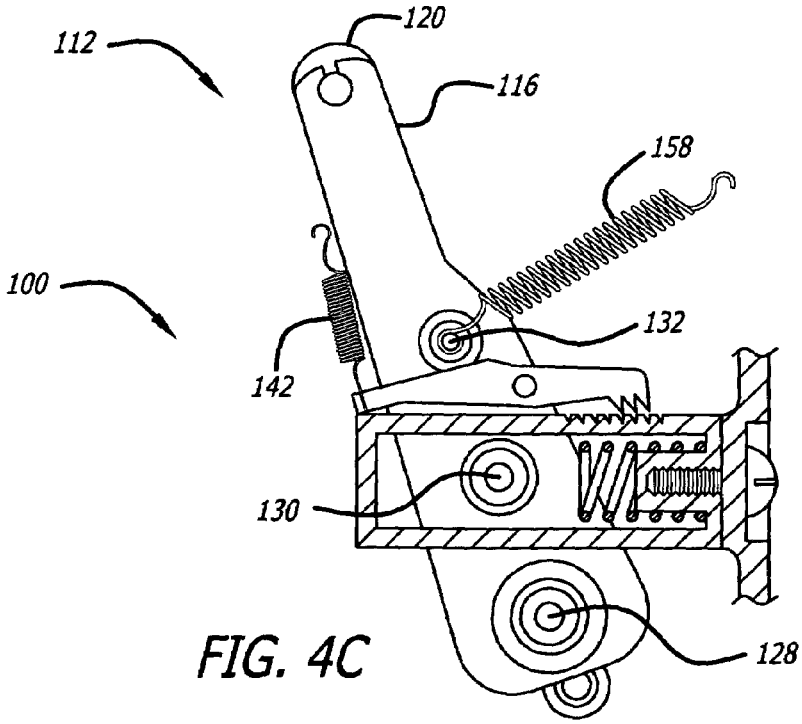
FIG. 4C is the same view as FIG. 4B, but with components of the media registration device removed for clarity.

In this example embodiment, the lever device 112 is mechanically coupled to the registration wall 110 and adapted to make contact with a portion of the printer 10 (e.g., the edge 12) when the media tray 20 is inserted into or withdrawn from the printer 10. An arrow 150 (FIG. 4A) indicates a direction of movement of the media registration device 100 in relation to the edge 12 when the media tray 20 is being withdrawn from the printer 10. Referring to FIGS. 4A-4C, the lever device 112 is adapted to pivot in relation to the media tray 20 when the media tray 20 is withdrawn from the printer 10. More specifically, when the media tray 20 is being withdrawn from the printer 10, the arm members 114 and 116 make contact with the edge 12 and pivot as shown. This pivoting motion of the arm members 114 and 116 causes the members 132 to contact a surface 152 of the ratchet device 140 which causes the ratchet device 140 to pivot about its bearing 154 against the bias imparted by the spring 142. This pivoting motion of the ratchet device 140, in turn, disengages the teeth 144 from the complementary teeth 146, which allows a spring 156 (FIG. 4B) to pull the registration wall 110 back toward its retracted position (i.e., a media release position). Thus, in an example embodiment, the media registration device 100 is adapted to automatically reposition the registration wall 110 to a media release position when the media tray 20 is withdrawn from the printer 10. In an example embodiment, the registration wall 110 is mechanically coupled to the lever device 112 such that the registration wall 110 is released from a media registration position when the media tray 20 is withdrawn from the printer 10. After the media registration device 100 advances past the edge 12 (when the media tray 20 is being withdrawn from the printer 10), a spring 158 biases the arm members 114 and 116 back toward their upright, substantially vertical positions.

In an example embodiment, the media registration device 100 is purely mechanical in operation. However, the media registration devices described herein can be modified to include electromechanical (e.g., solenoids) or other non-purely mechanical devices, as well as other arrangements of gears, levers, springs, and the like.

FIGS. 5A and 5B show the printer 10 and media tray 20 instead configured with a media registration device 200. In this example embodiment, the media registration device 200 includes a base 202 above rails 204 and 206, which are sized to fit within and slide along tracks 25 and 27, respectively, of the media tray 20. The media registration device 200 is mechanically coupled to the media tray 20. In this example embodiment, a tab member 208 of the media registration device 200 is inserted into a slot 29 to secure the media registration device 200 to the media tray 20. "Coarse" positional adjustments of the media registration device 200 along the tracks 25 and 27 are made by withdrawing the tab member 208 from one slot 29, and sliding the media registration device 200 to a desired position where the tab member 208 can be inserted into a different slot 29. In an example embodiment, the tab member 208 is sprung to bias the tab member 208 downward into a slot 29.

The media registration device 200 includes a registration wall 210 which is automatically extended and retracted when the media tray 20 is inserted into and withdrawn from the printer 10, respectively. After the media registration device 200 has been appropriately positioned for a particular media size, i.e., the "coarse" adjustment, the media registration device automatically provides "fine" positional adjustments of its registration wall 210 as discussed below.

Figure 6A:
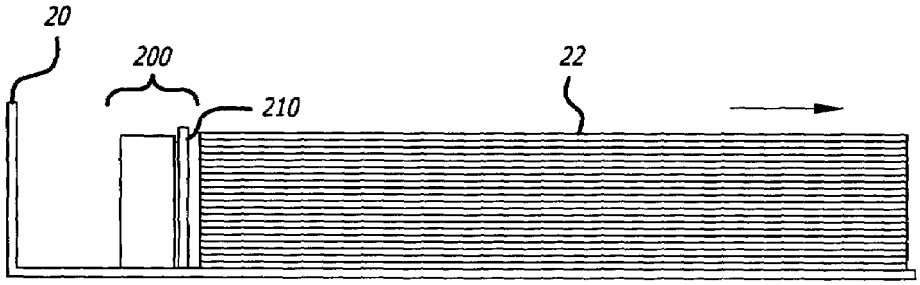
FIG. 6A is a cross-sectional view of a media tray with the media registration wall of the media registration device of FIG. 5A shown in its retracted position.
Figure 6B:
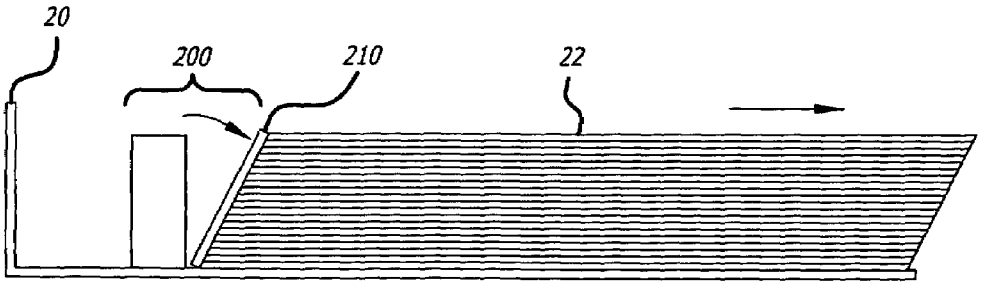
FIG. 6B is a top view of a media tray with the media registration wall of the media registration device of FIG. 5A shown in its tilted extended position.

FIG. 6A shows the registration wall 210 of the media registration device 200 in its retracted position. FIG. 6B shows the registration wall 210 of the media registration device 200 in its tilted extended position. The angle of the registration wall 210 is tilted as shown to locate the media beneath the pick roller (not shown) and against the pick wall (not shown). In this example embodiment, the registration wall 210 is mechanically coupled to the media registration device 200 such that the registration wall 210 is tilted toward the media stack 22 in the extended (or engaged) position.

Figure 7A:
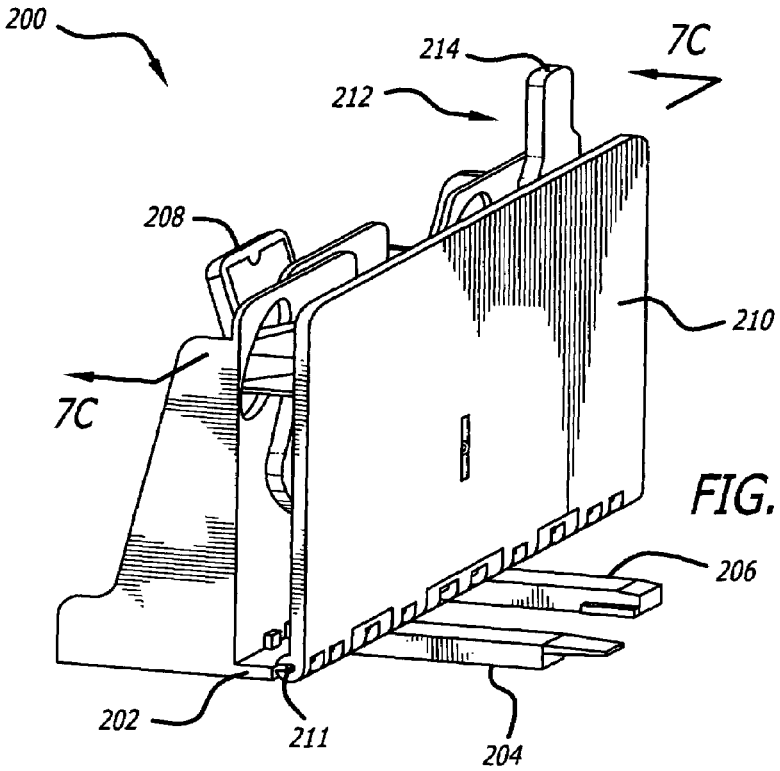
FIG. 7A is a perspective view of the media registration device of FIG. 5A with its media registration wall shown in its retracted position.
Figure 7B:
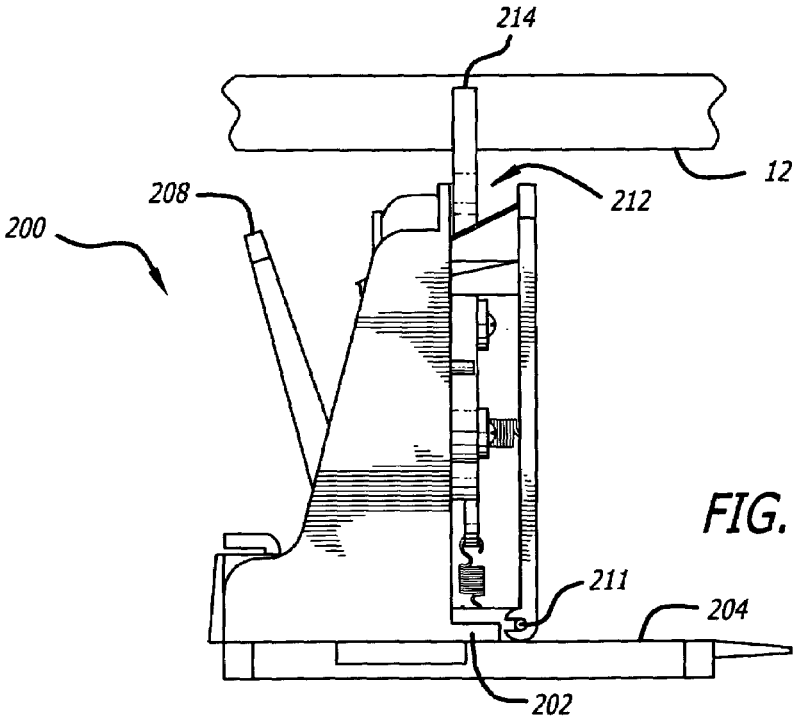
FIG. 7B is a side view of the media registration device of FIG. 7A.
Figure 7C:
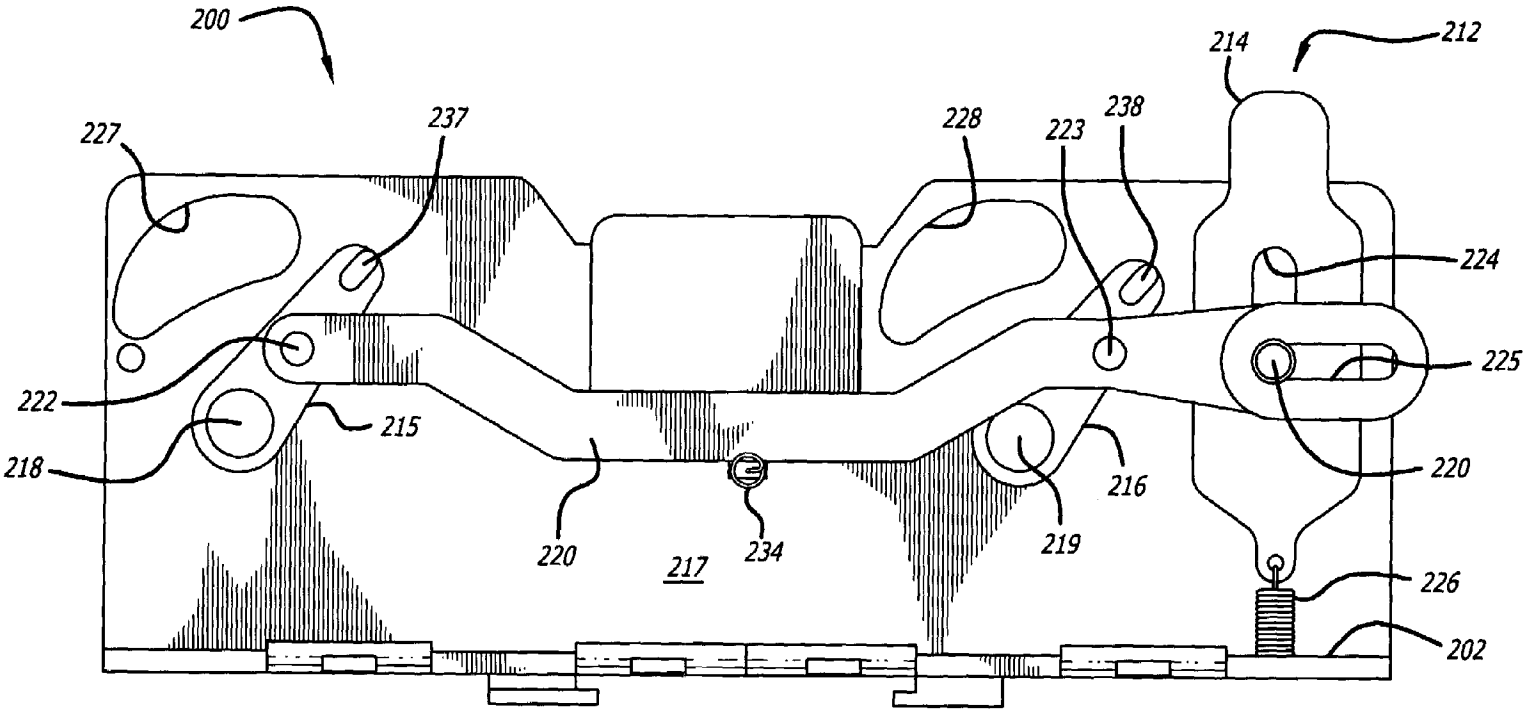
FIG. 7C is a cross-sectional front view of the media registration device of FIG. 7A.
Figure 8A:
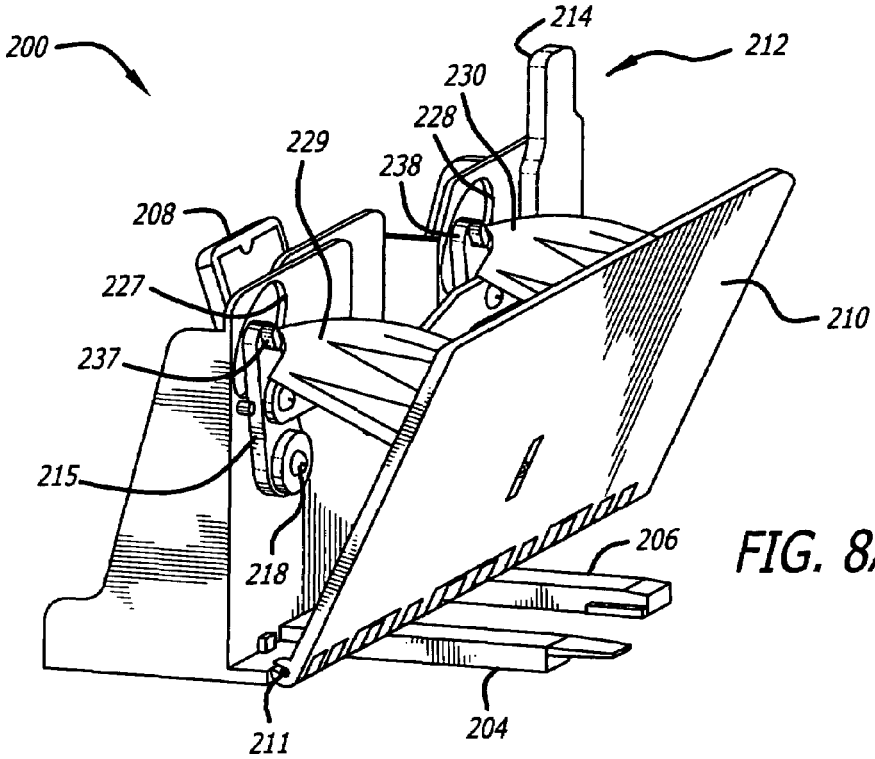
FIG. 8A is a perspective view of the media registration device of FIG. 5A with its media registration wall shown in its tilted extended position.
Figure 8B:
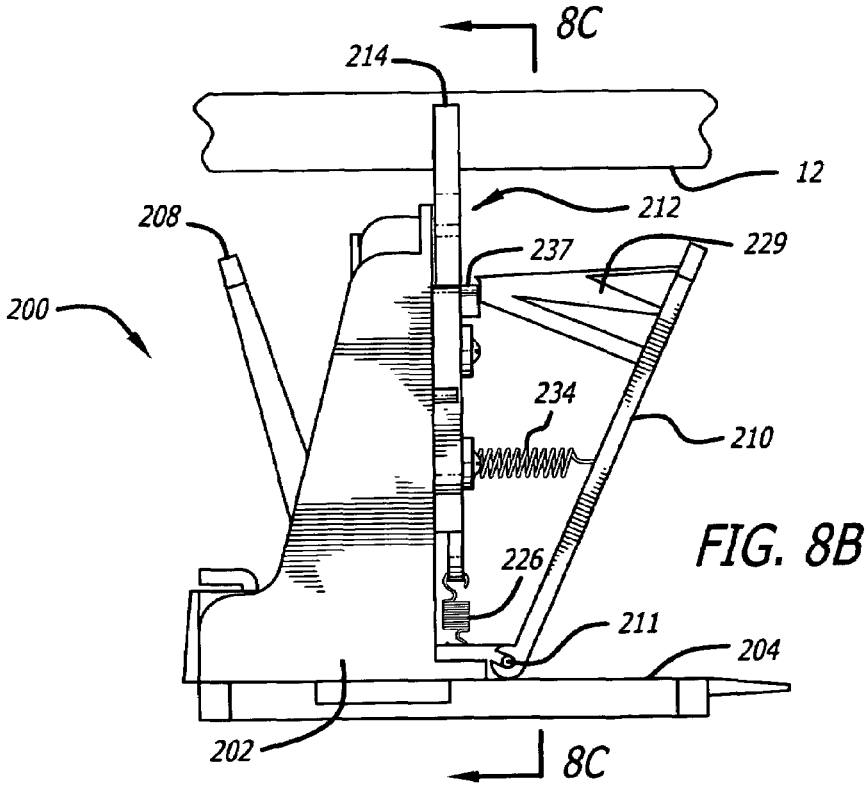
FIG. 8B is a cross-sectional side view of the media registration device of FIG. 8A.
Figure 8C:
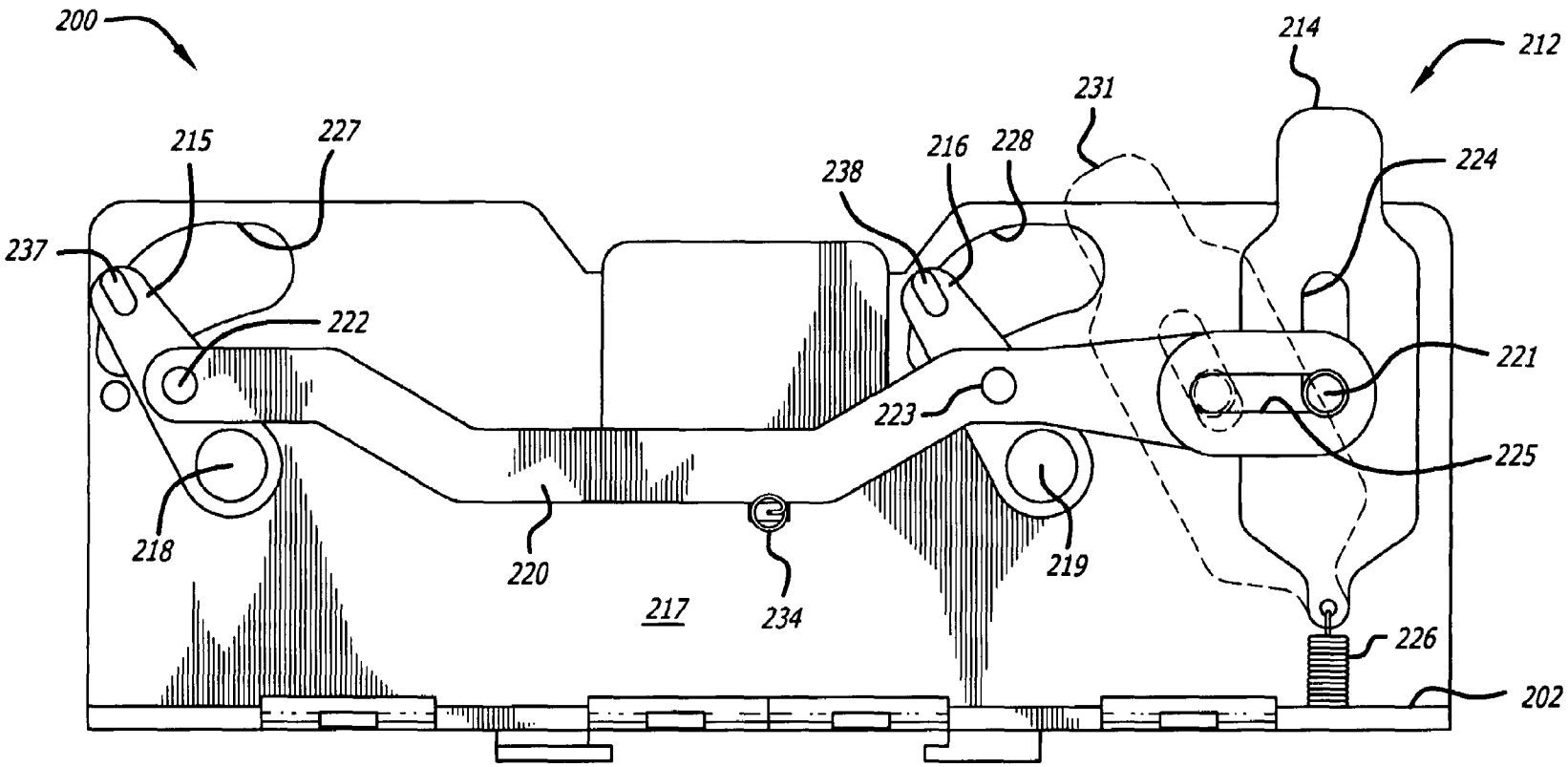
FIG. 8C is a cross-sectional front view of the media registration device along line 8C-8C of FIG. 8B.
Figure 8D:
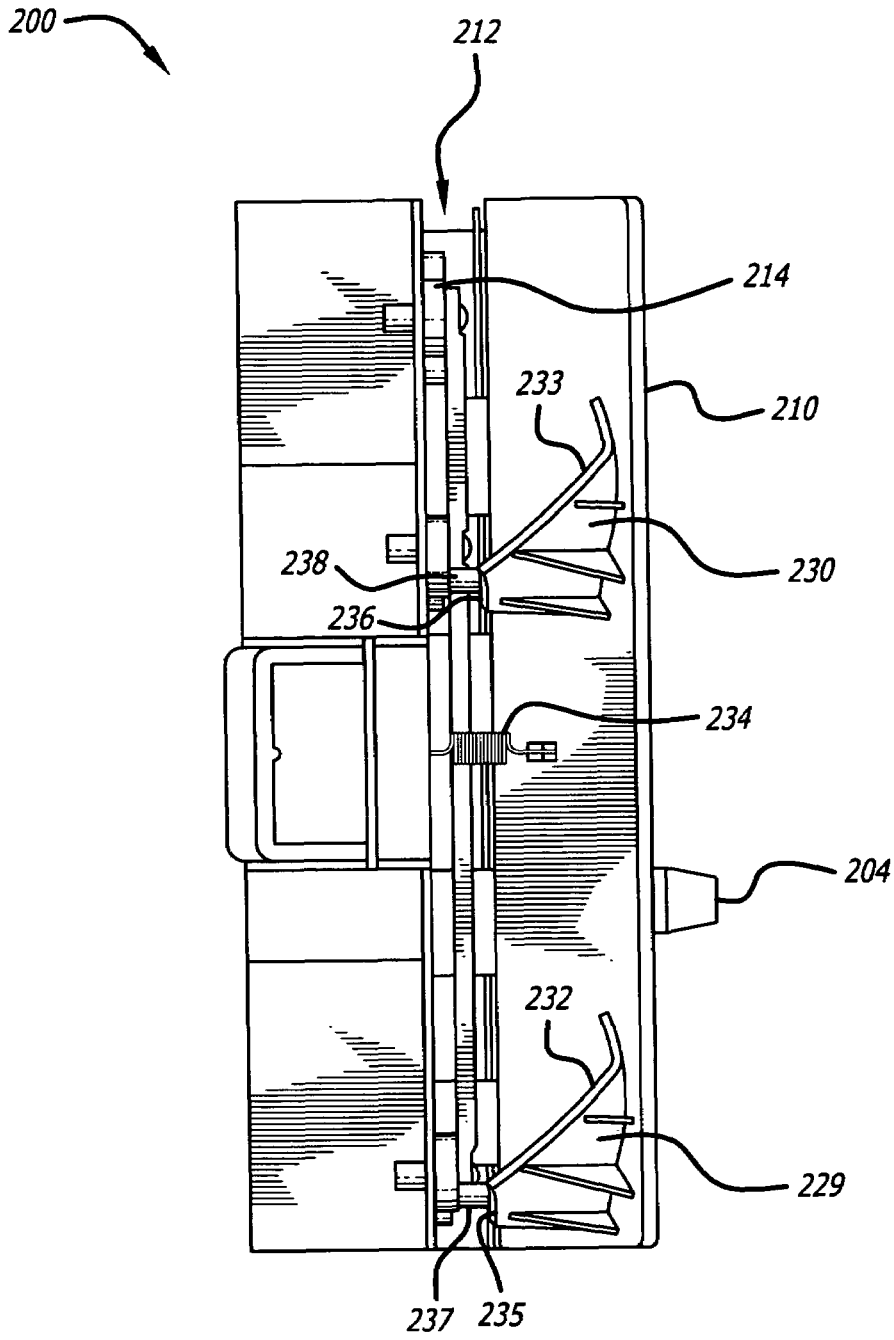
FIG. 8D is a top view of the media registration device of FIG. 8A.

Referring to FIGS. 7A-7C, the registration wall 210 is pivotally coupled at axis 211 to the base 202. In this example embodiment, the media registration device 200 includes a lever device 212 to which the registration wall 210 is mechanically coupled. In this example embodiment, the lever device 212 includes a single member (arm member) 214 for contacting a portion of the printer 10. It should be appreciated that the media registration device 200 can be modified to include multiple arm members.

FIG. 7B shows the media registration device 200 moving toward the edge 12 of the printer 10 as the media tray 20 is pushed into the printer 10. Referring to FIG. 7C, the media registration device 200 includes members 215 and 216 which are pivotally secured to a surface 217 of the media registration device 200 about bearings 218 and 219, respectively. In this example embodiment, the media registration device 200 further includes a member 220, which is pivotally coupled to the members 214, 215, and 216 as shown by bearings 221, 222, and 223, respectively. The bearing 221 passes as shown through channels 224 and 225 formed as shown in the members 214 and 220, respectively. A spring 226, which is attaches a bottom portion of the arm member 214 to the base 202, returns the arm member 214 to its upright (substantially vertical) position after the media registration device 200 has been pushed past the edge 12.

Referring also to FIGS. 8A-8D, in this example embodiment, the surface 217 includes apertures 227 and 228, and the back side of the registration wall 210 is provided with curved cantilevered members 229 and 230 as shown. In the retracted position for the media registration device 200 (FIGS. 7A-7C), the curved cantilevered members 229 and 230 extend through the apertures 227 and 228, respectively. When the media tray 20 is pushed into the printer 10, the arm member 214 makes contact with edge 12 and is pushed toward the curved cantilevered members 229 and 230. This pivoting of the arm member 214 (to the position shown by dashed line 231 in FIG. 8C), because of the mechanical coupling provided by the member 220, causes the members 215 and 216 to pivot in the same direction that the arm member 214 is pivoting. Thus, in an example embodiment, the lever device 212 and the registration wall 210 pivot about axes that are substantially perpendicular. During this pivoting motion, the members 215 and 216 contact edges 232 and 233 (of the curved cantilevered members 229 and 230, respectively) pushing the curved cantilevered members 229 and 230 away from the surface 217 against a bias provided by spring 234 which connects the back of the registration wall 210 to the surface 217. In this example embodiment, the curved cantilevered members 229 and 230 include recessed edges 235 and 236, respectively, which are formed as shown. In this example embodiment, the members 215 and 216 are provided with protrusions 237 and 238, respectively, which are formed as shown. When the registration wall 210 has pivoted to its tilted extended position, the protrusions 237 and 238 are seated within and adjacent to the recessed edges 235 and 236, respectively, which secures the registration wall 210 in this media registration position. When the media tray 20 is withdrawn from the printer 10, the arm member 214 again contacts the edge 12 causing the arm member 214 to move away from the curved cantilevered members 229 and 230. This movement, because of the linkage provided by the member 220, causes the members 215 and 216 to disengage from the recessed edges 235 and 236, respectively. This permits the spring 234 to pull the registration wall 210 back to its retracted position.

In an example embodiment, the media registration device 200 is purely mechanical in operation. However, as noted above, the media registration devices described herein can be modified to include electromechanical (e.g., solenoids) or other non-purely mechanical devices, as well as other arrangements of gears, levers, springs, and the like.

Although FIGS. 1A and 5A each show a single media registration device, in an example embodiment, an apparatus for automatically registering a stack of media includes a plurality of media registration devices adapted to be secured to a media tray of a printer, each of the media registration devices includes a registration wall and is adapted to reposition its registration wall toward the stack of media when the media tray is inserted into the printer. By way of example, the media tray 20 is provided with both of the media registration devices 100 and 200 adapted to serve as length and width adjusters (or vice versa). In an example embodiment, the media registration devices include actuation members (e.g., the arm members) adapted to contact a portion of the printer at different times as the media tray is inserted into (or withdrawn from) the printer. In an example embodiment, one of the media registration devices is adapted to laterally reposition its registration wall toward the stack of media, and another of the media registration devices is adapted to tilt its registration wall toward the stack of media. In an example embodiment, all of the media registration devices are purely mechanical in operation. However, one or more of the media registration devices can be modified to include electromechanical (e.g., solenoids) or other non-purely mechanical devices, as well as other arrangements of gears, levers, springs, and the like.

Although the present invention has been described in terms of the example embodiments above, numerous modifications and/or additions to the above-described embodiments would be readily apparent to one skilled in the art. It is intended that the scope of the present invention extends to all such modifications and/or additions.

What is claimed is:

1. An apparatus for automatically registering a stack of media comprising:

a lever device to be secured to a media tray of a printer, the lever device comprising:

a plurality of discrete arm members to contact a portion of the printer when the media tray is inserted into the printer such that the discrete arm members pivot in relation to the media tray when the media tray is inserted into the printer;

one or more cross members attached to the discrete arm members and positioned perpendicular to the discrete arm members, the cross members to move through corresponding slots of the lever device when the discrete arm members pivot in relation to the media tray when the media tray is inserted into the printer;

a registration wall mechanically coupled to the lever device such that the registration wall is repositioned toward the stack of media when the media tray is inserted into the printer.

2. The apparatus of claim 1, wherein the lever device further comprises a spring, the cross members to compress the spring when the cross members move through the corresponding slots of the lever device when the discrete arm members pivot in relation to the media tray when the media tray is inserted into the printer.

3. The apparatus of claim 1, wherein the registration wall is mechanically coupled to the lever device such that the registration wall is perpendicular to a bottom of the media tray and is perpendicular to the stack of media when the media tray is inserted into the printer.

4. The apparatus of claim 1, wherein the registration wall is mechanically coupled to the lever device such that the registration wall is tilted towards the stack of media when the media tray is inserted into the printer.

5. The apparatus of claim 4, wherein the lever device and the registration wall pivot about axes that are substantially perpendicular.

6. The apparatus of claim 1, wherein the discrete arm members are equal in number to two, and are positioned at opposite ends of the lever device.

7. The apparatus of claim 1, wherein the discrete arm members are equal in number to two, and are positioned at opposite ends of the registration wall.

8. The apparatus of claim 1, wherein the discrete arm members are symmetrically positioned along the lever device.

9. The apparatus of claim 1, wherein the discrete arm members are to pivot in relation to the media tray when the media tray is withdrawn from the printer.

10. The apparatus of claim 1, wherein the registration wall is mechanically coupled to the lever device such that the registration wall is released from a media registration position when the media tray is withdrawn from the printer.

11. An apparatus comprising:

a printer including a media tray, the printer to withdraw an article of media from the media tray and to impart visible indicia upon the article of media;

a media registration device for automatically registering a stack of media within the media tray of the printer, the media registration device comprising:

a lever device to be secured to the media tray of the printer, the lever device comprising:

a plurality of discrete arm members to contact a portion of the printer when the media tray is inserted into the printer such that the discrete arm members pivot in relation to the media tray when the media tray is inserted into the printer;

one or more cross members attached to the discrete arm members and positioned perpendicular to the discrete arm members, the cross members to move through corresponding slots of the lever device when the discrete arm members pivot in relation to the media tray when the media tray is inserted into the printer;

a registration wall mechanically coupled to the lever device such that the registration wall is repositioned toward the stack of media when the media tray is inserted into the printer.

12. The apparatus of claim 11, wherein the lever device further comprises a spring, the cross members to compress the spring when the cross members move through the corresponding slots of the lever device when the discrete arm members pivot in relation to the media tray when the media tray is inserted into the printer.

13. The apparatus of claim 11, wherein the registration wall is mechanically coupled to the lever device such that the registration wall is perpendicular to a bottom of the media tray and is perpendicular to the stack of media when the media tray is inserted into the printer.

14. The apparatus of claim 11, wherein the registration wall is mechanically coupled to the lever device such that the registration wall is tilted towards the stack of media when the media tray is inserted into the printer.

15. The apparatus of claim 11, wherein the discrete arm members are equal in number to two, and are positioned at opposite ends of the lever device.

16. The apparatus of claim 11, wherein the discrete arm members are equal in number to two, and are positioned at opposite ends of the registration wall.

17. The apparatus of claim 11, wherein the discrete arm members are symmetrically positioned along the lever device.

18. The apparatus of claim 11, wherein the discrete arm members are to pivot in relation to the media tray when the media tray is withdrawn from the printer.

19. The apparatus of claim 11, wherein the registration wall is mechanically coupled to the lever device such that the registration wall is released from a media registration position when the media tray is withdrawn from the printer.

20. A method for automatically registering a stack of media, comprising:

inserting a media tray into a printer;

insertion of the media tray into the printer causing a plurality of discrete arm members of a lever device secured to the media tray to contact a portion of the printer and pivot in relation to the media tray;

pivoting of the discrete arm members causing one or more cross members of the lever device attached to the discrete arm members and positioned perpendicular to the discrete arm members to move through corresponding slots of the lever device; and, movement of the cross members causing a registration wall mechanically coupled to the lever device to be repositioned towards the stack of media.

* * * * *